US010968607B2

(12) United States Patent
Iwamura et al.

(10) Patent No.: US 10,968,607 B2
(45) Date of Patent: Apr. 6, 2021

(54) CALIBRATION DEVICE OF WORK MACHINE, WORK MACHINE, AND CALIBRATION METHOD OF WORK MACHINE

(71) Applicant: Komatsu Ltd., Tokyo (JP)

(72) Inventors: Tsutomu Iwamura, Yokohama (JP); Masanobu Seki, Fujisawa (JP); Masashi Ichihara, Hiratsuka (JP); Kenjiro Shimada, Komatsu (JP); Satoru Shintani, Hirakata (JP); Yuki Shimano, Suita (JP); Eiji Ishibashi, Komatsu (JP)

(73) Assignee: KOMATSU LTD., Tokyo (JP)

( * ) Notice: Subject to any disclaimer, the term of this patent is extended or adjusted under 35 U.S.C. 154(b) by 178 days.

(21) Appl. No.: 15/574,951

(22) PCT Filed: Oct. 28, 2015

(86) PCT No.: PCT/JP2015/080375
§ 371 (c)(1),
(2) Date: Nov. 17, 2017

(87) PCT Pub. No.: WO2017/072877
PCT Pub. Date: May 4, 2017

(65) Prior Publication Data

US 2018/0171598 A1 Jun. 21, 2018

(51) Int. Cl.
*E02F 3/04* (2006.01)
*E02F 3/28* (2006.01)
(Continued)

(52) U.S. Cl.
CPC ..... *E02F 9/268* (2013.01); *E02F 3/434* (2013.01); *E02F 3/435* (2013.01); *E02F 9/2004* (2013.01);
(Continued)

(58) Field of Classification Search
CPC combination set(s) only.
See application file for complete search history.

(56) References Cited

U.S. PATENT DOCUMENTS 5,957,989 A 9/1999 Egawa et al.
8,838,329 B2 9/2014 Seki
(Continued)

FOREIGN PATENT DOCUMENTS

CN 1165895 A 11/1997
CN 103080427 A 5/2013
(Continued)

OTHER PUBLICATIONS

International Search Report dated Dec. 8, 2015, issued for PCT/JP2015/080375.

*Primary Examiner* — Adam D Tissot
(74) *Attorney, Agent, or Firm* — Locke Lord LLP

(57) ABSTRACT

When correcting an error caused by deviation of an attitude detection device with respect to a work machine including a swing body which swings, a working implement being attached to the swing body, the attitude detection device outputting an attitude of the work machine, the error is corrected by using a first position which is a position of a part of the work machine when the work machine is in a first attitude and a second position which is a position of the part when the work machine is in a second attitude.

11 Claims, 8 Drawing Sheets

(51) Int. Cl.

| | |
|---|---|
| ***E02F 9/24*** | (2006.01) |
| ***E02F 9/26*** | (2006.01) |
| ***E02F 3/43*** | (2006.01) |
| ***E02F 9/20*** | (2006.01) |
| *E02F 3/84* | (2006.01) |
| *E02F 9/22* | (2006.01) |

(52) U.S. Cl.
CPC ..... *E02F 9/2029* (2013.01); *E02F 9/264* (2013.01); *E02F 9/265* (2013.01); *E02F 3/844* (2013.01); *E02F 9/2296* (2013.01)

(56) References Cited

U.S. PATENT DOCUMENTS

| | | | | |
|---|---|---|---|---|
| 9,115,483 | B2 | 8/2015 | Sakuda et al. | |
| 9,157,216 | B2 | 10/2015 | Seki | |
| 9,915,054 | B2 | 3/2018 | Wu | |
| 2004/0010359 | A1* | 1/2004 | Koch | E02F 3/435 701/50 |
| 2005/0197755 | A1* | 9/2005 | Knowlton | G01S 19/50 701/50 |
| 2008/0097673 | A1* | 4/2008 | Tomita | E02F 3/404 701/50 |
| 2012/0099955 | A1* | 4/2012 | Glitza | G01C 9/06 414/687 |
| 2013/0158788 | A1 | 6/2013 | Seki | |
| 2013/0158789 | A1 | 6/2013 | Seki | |
| 2015/0039189 | A1 | 2/2015 | Wu | |
| 2015/0066312 | A1 | 3/2015 | Sakuda et al. | |
| 2018/0187394 | A1 | 7/2018 | Wu | |

FOREIGN PATENT DOCUMENTS

| | | | |
|---|---|---|---|
| CN | 104246081 | A | 12/2014 |
| EP | 1835079 | B1 | 5/2008 |
| JP | 2000-241306 | A | 9/2000 |
| JP | 2004-132137 | A | 1/2004 |
| JP | 2010-229663 | A | 10/2010 |
| JP | 2014-137343 | A | 7/2014 |
| JP | 2015-001385 | A | 1/2015 |
| KR | 2013-0069742 | A | 6/2013 |
| KR | 2015-0041151 | A | 4/2015 |

* cited by examiner

CALIBRATION DEVICE OF WORK MACHINE, WORK MACHINE, AND CALIBRATION METHOD OF WORK MACHINE

FIELD

The present invention relates to a calibration device of a work machine, a work machine, and a calibration method of a work machine.

BACKGROUND

As a work machine provided with a swing body, one provided with a gyro sensor is known as a device for detecting and specifying a working attitude (for example, Patent Literature 1).

CITATION LIST

Patent Literature

Patent Literature 1: Japanese Laid-open Patent Publication No. 2015-001385 A

SUMMARY

Technical Problem

A device which detects an attitude of a work machine (hereinafter appropriately referred to as an attitude detection device) is attached to the work machine to detect acceleration and an angular speed. When the attitude detection device is attached with deviation from a reference position at which this should be attached to the work machine, a detection value includes an error. Since the attitude of the work machine obtained using the detection value including the error also includes an error, it is necessary to correct the error included in the detection value of the attitude detection device. In a case where an axis serving as reference of the attitude detection device is deviated in a yaw direction with respect to a longitudinal axis of the work machine, an attitude angle of a working implement detected by the attitude detection device might be inclined.

An object of the present invention is to correct the error included in the detection value of the attitude detection device caused by generation of the inclination because the attitude detection device is installed with deviation in yaw angle with respect to the longitudinal direction of the work machine.

Solution to Problem

According to an aspect of the present invention, a calibration device of a work machine, the work machine including a swing body which swings, a working implement being attached to the swing body, the calibration device is configured to, when correcting an error caused by deviation of an attitude detection device with respect to the work machine, the attitude detection device outputting an attitude of the work machine, correct the error using a first position which is a position of a part of the work machine when the work machine is in a first attitude and a second position which is a position of the part when the work machine is in a second attitude.

It is preferable that the position of the part includes a position of a part of the working implement, the first position includes a position when the work machine is installed on an inclined surface and the swing body faces in a first direction, and the second position includes a position when the work machine is installed on the inclined surface and the swing body faces in a second direction.

It is preferable that the first position and the second position include positions when a pitch angle output by the attitude detection device is 0 degree.

It is preferable that the position of the part includes a position of a part of the working implement included in the work machine.

It is preferable that the first position and the second position include positions of the part obtained by using a position other than the work machine as a standard, the positions being obtained by using information regarding the attitude of the work machine output from the attitude detection device.

It is preferable that the calibration device is configured to repeat recalculation of the first position and the second position while correcting a parameter for correcting the information regarding the attitude of the work machine to correct the error by using the parameter when the difference between the first position and the second position becomes equal to or smaller than a threshold.

It is preferable that the information regarding the attitude of the work machine includes a pitch angle and a roll angle output by the attitude detection device.

According to another aspect of the present invention, a work machine includes the calibration device of the work machine.

According to a still another aspect of the present invention, a calibration method of a work machine comprises: obtaining a first position which is a position of a part of a work machine when the work machine is in a first attitude, the work machine including a swing body which swings, a working implement being attached to the swing body; obtaining a second position which is a position of the part when the work machine is in a second attitude; and correcting an error by using the first position and the second position, the error caused by deviation of an attitude detection device with respect to the work machine, the attitude detection device outputting an attitude of the work machine.

According to an aspect of the present invention, the error included in the detection value of the attitude detection device caused by generation of the inclination because the attitude detection device is installed with deviation in yaw angle with respect to the longitudinal direction of the work machine can be corrected.

DESCRIPTION OF EMBODIMENTS

A mode for carrying out the present invention (embodiment) is described in detail with reference to the drawings.

First Embodiment

<Overall Configuration of Work Machine>

Figure 1:
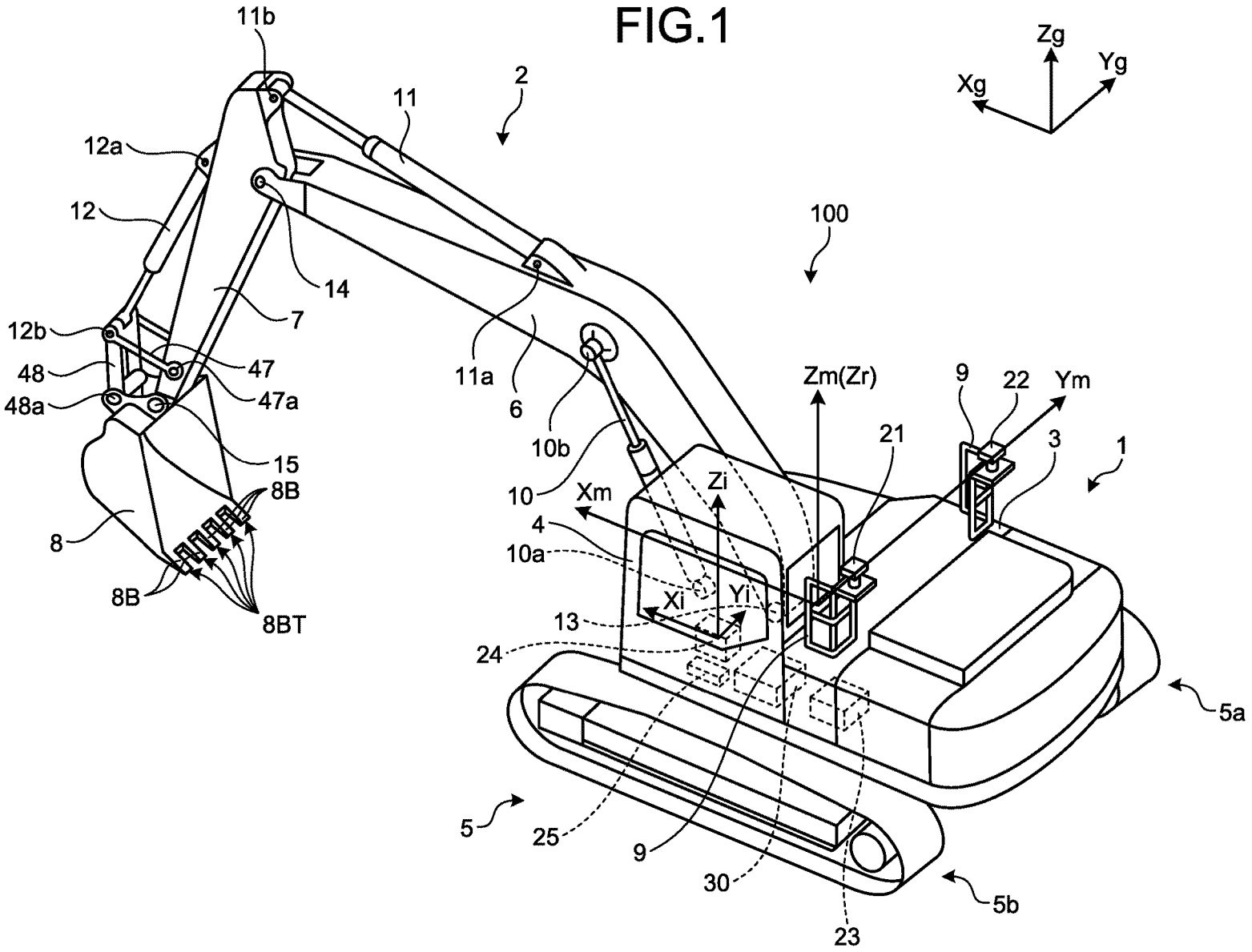
FIG. 1 is a perspective view of a work machine according to a first embodiment.
Figure 2:
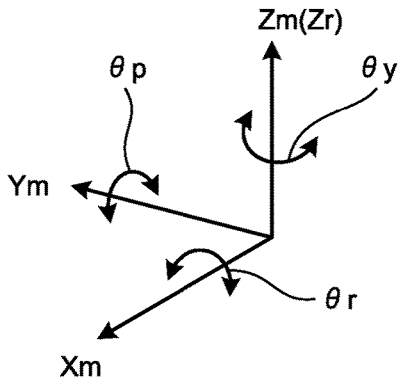
FIG. 2 is a view for illustrating a vehicle body coordinate system.

FIG. 1 is a perspective view of a work machine according to a first embodiment. FIG. 2 is a view for illustrating a vehicle body coordinate system. In this embodiment, the work machine is an excavator 100. The excavator 100 includes a vehicle body 1 and a working implement 2. The vehicle body 1 includes a swing body 3, a driving room 4, and a travel body 5. The swing body 3 is attached to the travel body 5 so as to be swingable around a swing central axis Zr. The swing body 3 accommodates devices such as a hydraulic pump and an engine.

The swing body 3 to which the working implement 2 is attached swings. A handrail 9 is attached to an upper part of the swing body 3. Antennas 21 and 22 are attached to the handrail 9. The antennas 21 and 22 are real time kinematic-global navigation satellite systems (RTK-GNSS: GNSS refers to global navigation satellite system) antennas. The antennas 21 and 22 are arranged apart from each other by a constant distance in a Ym axis of the vehicle body coordinate system (Xm, Ym, Zm). The antennas 21 and 22 receive GNSS radio waves and output signals according to the received GNSS radio waves. The antennas 21 and 22 may also be global positioning system (GPS) antennas.

The driving room 4 is mounted on a front part of the swing body 3. The travel body 5 includes crawler belts 5*a* and 5*b*. As the crawler belts 5*a* and 5*b* rotate, the excavator 100 travels.

The working implement 2 is attached to a front part of the vehicle body 1 and includes a boom 6, an arm 7, a bucket 8, a boom cylinder 10, an arm cylinder 11, and a bucket cylinder 12. A proximal end of the boom 6 is rotatably attached to the front part of the vehicle body 1 via a boom pin 13. That is, the boom pin 13 corresponds to a rotation center of the boom 6 with respect to the swing body 3. A proximal end of the arm 7 is rotatably attached to a distal end of the boom 6 via an arm pin 14. That is, the arm pin 14 corresponds to a rotation center of the arm 7 with respect to the boom 6. The bucket 8 is rotatably attached to a distal end of the arm 7 via a bucket pin 15. That is, the bucket pin 15 corresponds to a rotation center of the bucket 8 with respect to the arm 7.

The boom cylinder 10, the arm cylinder 11, and the bucket cylinder 12 illustrated in FIG. 1 are hydraulic cylinders driven by hydraulic pressure. A proximal end of the boom cylinder 10 is rotatably attached to the swing body 3 via a boom cylinder foot pin 10*a*. A distal end of the boom cylinder 10 is rotatably attached to the boom 6 via a boom cylinder top pin 10*b*. The boom cylinder 10 extends and contracts by hydraulic pressure, thereby driving the boom 6.

A proximal end of the arm cylinder 11 is rotatably attached to the boom 6 via an arm cylinder foot pin 11*a*. A distal end of the arm cylinder 11 is rotatably attached to the arm 7 via an arm cylinder top pin 11*b*. The arm cylinder 11 extends and contracts by hydraulic pressure to drive the arm 7.

A proximal end of the bucket cylinder 12 is rotatably attached to the arm 7 via a bucket cylinder foot pin 12*a*. A distal end of the bucket cylinder 12 is rotatably attached to one end of a first link member 47 and one end of a second link member 48 via a bucket cylinder top pin 12*b*. The other end of the first link member 47 is rotatably attached to the distal end of the arm 7 via a first link pin 47*a*. The other end of the second link member 48 is rotatably attached to the bucket 8 via a second link pin 48*a*. The bucket cylinder 12 extends and contracts by hydraulic pressure to drive the bucket 8.

The bucket 8 includes a plurality of blades 8B. A plurality of blades 8B is aligned in a width direction of the bucket 8. A distal end of the blade 8B is a blade edge 8BT. The bucket 8 is an example of a working tool. The working tool is not limited to the bucket 8. The working tool may be, for example, a tilt bucket including a single blade, or a rock drilling attachment provided with a legal bucket or a rock drilling chip, or may be other than them.

A position detection device 23, an inertial measurement unit (IMU) 24 as an example of an attitude detection device, a calibration device 30 of the work machine, and a control device 25 which controls the excavator 100 are attached to the swing body 3. The signals from the antennas 21 and 22 are input to the position detection device 23. The position detection device 23 detects current positions of the antennas 21 and 22 and an orientation of the swing body 3 in a global coordinate system (Xg, Yg, Zg) by using the signals obtained from the antennas 21 and 22 to output. The orientation of the swing body 3 represents a direction of the swing body 3 in the global coordinate system. The direction of the swing body 3 may be represented by, for example, a longitudinal direction of the swing body 3 around a Zg axis of the global coordinate system. In this embodiment, the orientation of the swing body 3 is represented by an azimuth angle θd. The azimuth angle θd is a rotation angle around the Zg axis of the global coordinate system of a reference axis in the longitudinal direction of the swing body 3. In this embodiment, the position detection device 23 calculates the azimuth angle θd from relative positions of the two antennas 21 and 22.

Next, the coordinate system is described. The vehicle body coordinate system (Xm, Ym, Zm) described above is the coordinate system based on an origin fixed to the vehicle body 1, the swing body 3 in this embodiment. In the embodiment, the origin of the vehicle body coordinate system (Xm, Ym, Zm) is, for example, the center of a swing circle of the swing body 3. The center of the swing circle is present on a swing central axis Zr of the swing body 3. A Zm axis of the vehicle body coordinate system (Xm, Ym, Zm) is the axis which becomes the swing central axis Zr of the swing body 3, an Xm axis is the axis extending in the longitudinal direction of the swing body 3 and orthogonal to the Zm axis, and a Ym axis is the axis extending in a width direction of the swing body 3 orthogonal to the Zm axis and the Xm axis. The Xm axis is the reference axis in the longitudinal direction of the swing body 3. The above-described global coordinate system (Xg, Yg, Zg) is the coordinate system measured by the GNSS, the coordinate system based on the origin fixed on the earth. As illustrated in FIG. 1, the IMU 24 includes its own coordinate system (Xi, Yi, Zi).

In this embodiment, the IMU 24 is installed under the driving room 4. The IMU 24 detects acceleration acting on the excavator 100. The IMU 24 may detect an inclination angle in the width direction of the vehicle body 1, the swing body 3 in this embodiment. In this embodiment, the width direction of the vehicle body 1 is a direction parallel to an axial direction of the boom pin 13. The inclination angle in the width direction of the vehicle body 1 is an angle θr around the Xm axis of the vehicle body coordinate system (Xm, Ym, Zm) illustrated in FIG. 2. Hereinafter, the angle θr is appropriately referred to as a roll angle θr.

The IMU 24 may detect the inclination angle in the longitudinal direction of the vehicle body 1, the swing body 3 in this embodiment with respect to a direction in which gravity acts from a detected angular speed. The longitudinal direction of the vehicle body 1 is a direction in which the Xm axis of the vehicle body coordinate system (Xm, Ym, Zm) illustrated in FIG. 2 extends. The inclination angle in the longitudinal direction of the vehicle body 1 is an angle θp around the Ym axis of the vehicle body coordinate system (Xm, Ym, Zm) illustrated in FIG. 2. Hereinafter, the angle θp is appropriately referred to as a pitch angle θp.

The IMU 24 may obtain information necessary for controlling the excavator 100 such as the acceleration, the angular speed, the roll angle θr, the pitch angle θp, and a yaw angle θy of the excavator 100 with a single device. The control device 25 controls the working implement 2 using a position of the working implement 2, for example, a position of the blade edge 8BT of the bucket 8 in the global coordinate system. When obtaining the position of the working implement 2 in the global coordinate system, the roll angle θr, the pitch angle θp, and the azimuth angle θd are used. Although the calibration device 30 of the work machine obtains the position of the working implement 2 in this embodiment, the position of the working implement 2 may also be obtained by the control device 25 or by a device other than the control device 25.

<Calibration Device 30 of Work Machine and Calibration System 40 of Work Machine>

Figure 3:
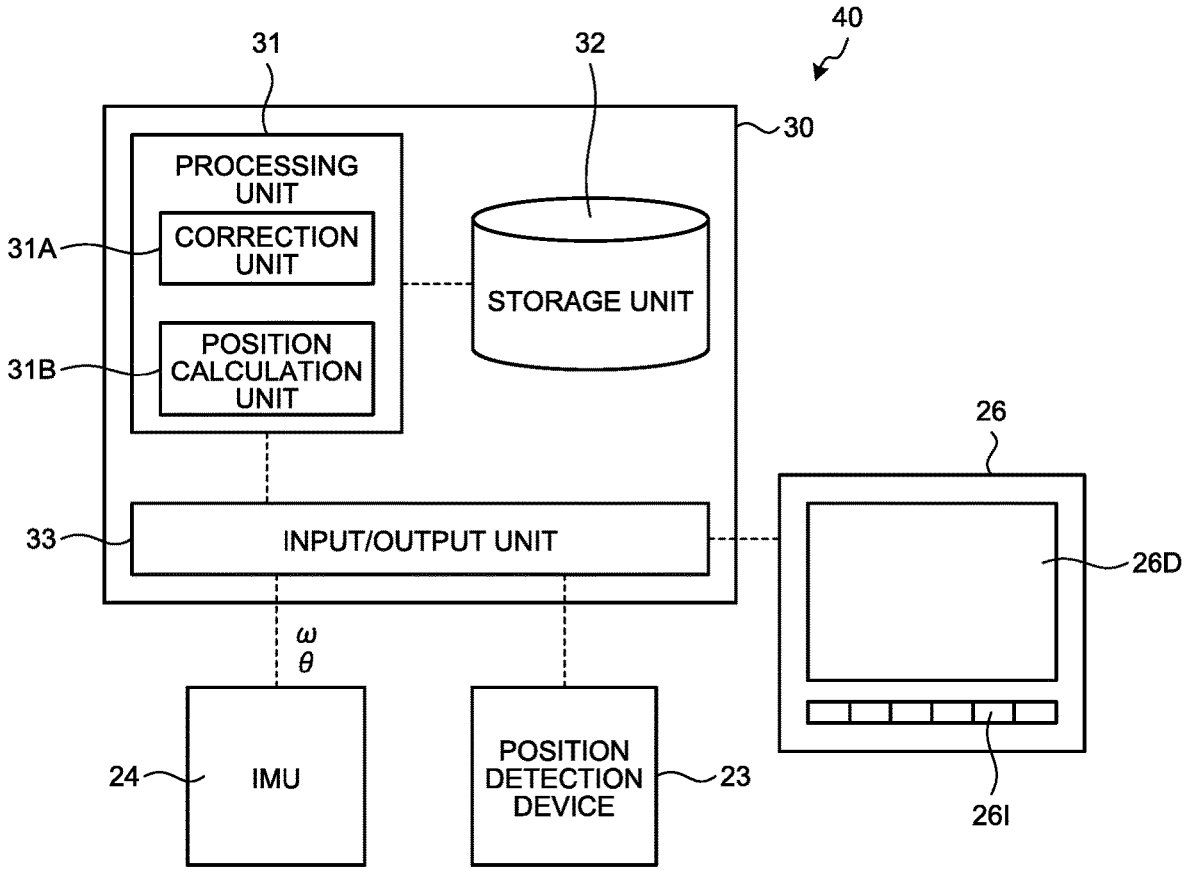
FIG. 3 is a view illustrating an example of a calibration system of a work machine including a calibration device of the work machine according to the first embodiment.

FIG. 3 is a view illustrating an example of a calibration system 40 of the work machine including the calibration device 30 of the work machine according to the first embodiment. The calibration system 40 of the work machine includes the calibration device 30 of the work machine, the position detection device 23, the IMU 24, and an input/output device 26. In this embodiment, the position detection device 23 is not necessarily required. Hereinafter, the calibration device 30 of the work machine is appropriately referred to as the calibration device 30, and the calibration system 40 of the work machine is appropriately referred to as the calibration system 40.

The calibration device 30 includes a processing unit 31, a storage unit 32, and an input/output unit 33. The processing unit 31 includes a correction unit 31A and a position calculation unit 31B. The processing unit 31 is, for example, a processor such as a central processing unit (CPU) and a memory. The processing unit 31 executes a calibration method of the work machine according to the embodiment. The correction unit 31A mainly corrects an error included in a detection value of the IMU 24 caused by generation of inclination when the IMU 24 is installed with the yaw angle deviated with respect to the longitudinal direction of the excavator 1 by executing the calibration method of the work machine according to this embodiment. The position calculation unit 31B mainly obtains the position of the working implement 2 using the corrected detection value of the IMU 24.

As the storage unit 32, at least one of a nonvolatile or volatile semiconductor memory such as a random access memory (RAM), a random access memory (ROM), a flash memory, an erasable programmable random access memory (EPROM), an electrically erasable programmable random access memory (EEPROM), a magnetic disk, a flexible disk, and a magneto-optical disk is used.

The storage unit 32 stores a computer program for allowing the processing unit 31 to execute the calibration method of the work machine according to the embodiment and information used when the processing unit 31 executes the calibration method of the work machine according to the embodiment. The processing unit 31 realizes the calibration method of the work machine according to the embodiment by reading the above-described computer program from the storage unit 32 and executing the same. The input/output unit is an interface circuit for connecting the calibration device 30 to the devices. The IMU 24, the position detection device 23, and the input/output device 26 are connected to the input/output unit 33.

The input/output device 26 includes a display unit 26D and an input unit 261. The display unit 26D of the input/output device 26 displays, for example, a calculation result of the calibration device 30 and information input to the calibration device 30. The display unit 26D is a liquid crystal display, an organic electro luminescence (EL) display or the like, but this not limited thereto. The input unit 261 is a button-type input key for inputting the information to the calibration device 30, but this is not limited thereto.

Since the IMU 24 cannot be arranged at the swing center of the swing body 3 serving as a reference position of the vehicle body coordinate system, the coordinate system (Xi, Yi, Zi) of the IMU 24 is different from the vehicle body coordinate system (Xm, Ym, Zm). In the IMU 24, if an Xi axis of the coordinate system (Xi, Yi, Zi) of the IMU 24 is parallel to the Xm axis of the vehicle body coordinate system (Xm, Ym, Zm), accuracy of the roll angle θr and the pitch angle θp obtained from the angular speed and the acceleration detected by the IMU 24 are assured. In this embodiment, the Xi axis is a reference axis of the IMU 24. If the Xi axis of the IMU 24 has deviation in yaw angle with respect to the Xm axis of the vehicle body coordinate system, that is, angular deviation, the IMU 24 attached to the swing body 3 being a part of the excavator 100 has angular deviation with respect to the swing body 3. This angular deviation is hereinafter appropriately referred to as an attachment error. This indicates deviation of the IMU 24 with respect to the excavator 100. In a case where the IMU 24 has the attachment error, the pitch angle θp and the roll angle θr of the excavator 100 detected by the IMU 24 and recognized by the calibration device 30 include errors. That is, the detection value of the IMU 24 includes the error caused by the attachment error of the IMU 24. This error is hereinafter appropriately referred to as a measurement error.

Figure 4:
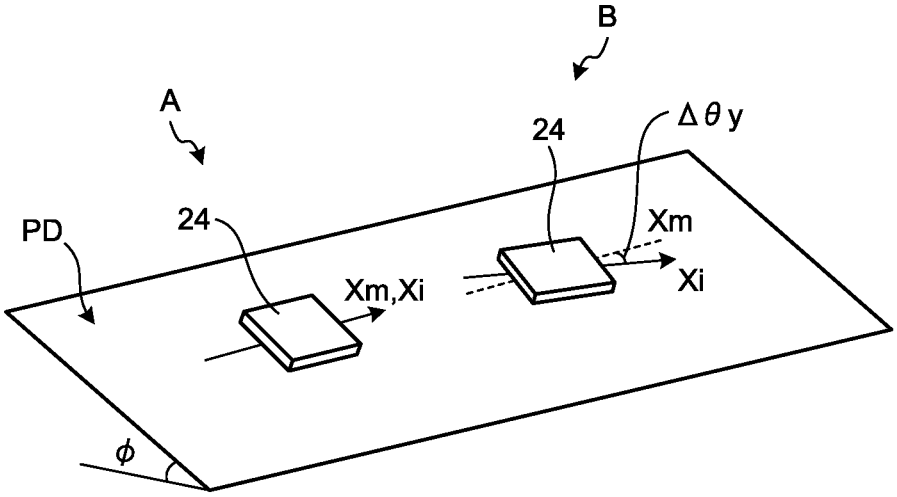
FIG. 4 is a view illustrating a case where an IMU has an attachment error and a case where this does not have the attachment error in a case where an excavator is placed on an inclined surface.
Figure 5:
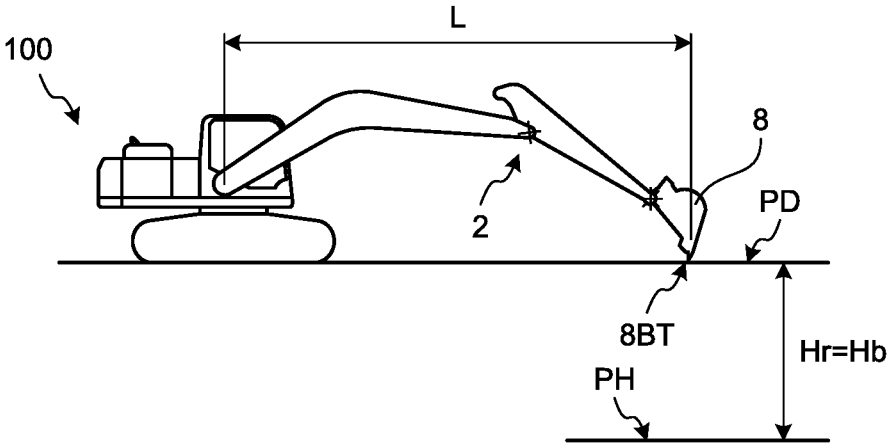
FIG. 5 is a view for illustrating a position of a blade edge in the case where the IMU does not have the attachment error.
Figure 6:
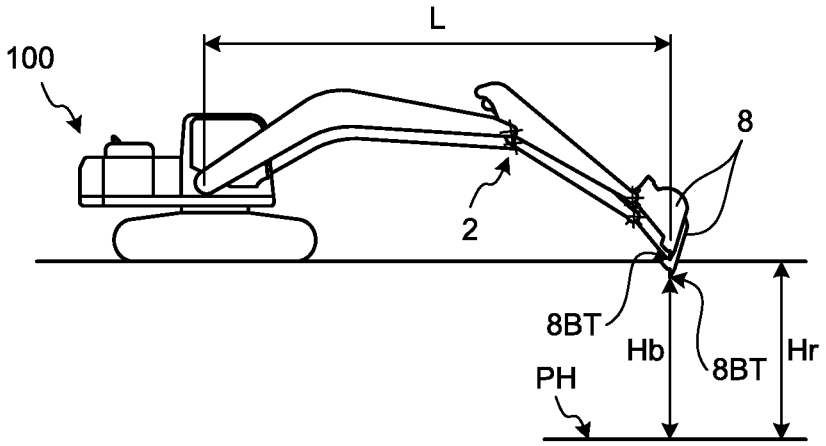
FIG. 6 is a view for illustrating the position of the blade edge in the case where the IMU has the attachment error.

FIG. 4 is a view illustrating a case where the IMU 24 has the attachment error and a case where this does not have the attachment error in a case where the excavator 100 is placed on an inclined surface PD. FIG. 5 is a view for illustrating the position of the blade edge 8BT in the case where the IMU 24 does not have the attachment error. FIG. 6 is a view for illustrating the position of the blade edge 8BT in the case where the IMU 24 has the attachment error.

FIG. 4 illustrates a state of the IMU 24 when the excavator 100 illustrated in FIG. 1 is placed on the inclined surface PD with an inclination angle of $\phi$ from a horizontal surface. A in FIG. 4 illustrates a case where the Xi axis of the coordinate system of the IMU 24 and the Xm axis of the vehicle body coordinate system are parallel to each other. That is, the case where the IMU 24 does not have the attachment error is illustrated. B in FIG. 4 illustrates a case where the Xi axis of the coordinate system of the IMU 24 and the Xm axis of the vehicle body coordinate system are not parallel to each other. This example illustrates the case where the IMU 24 has the attachment error. Specifically, this is a state in which the IMU 24 rotates around the Xi axis of the coordinate system of the IMU 24 illustrated in FIG. 1 to be attached to the vehicle body 1, the swing body 3 in this embodiment, so that the Xi axis of the coordinate system of the IMU 24 is deviated by an angle $\Delta\theta y$ with respect to the Xm axis of the vehicle body coordinate system. That is, this is a state in which the IMU 24 is attached with the deviation in yaw direction with respect to the longitudinal direction of the excavator 100.

In the case where the IMU 24 does not have the attachment error, the pitch angle $\theta p$ is 0 degree and the roll angle $\theta r$ is $\phi$. In the case where the IMU 24 has the attachment error, the pitch angle $\theta p$ has a value different from 0 degree, and the roll angle $\theta r$ has a value different from $\phi$.

In FIGS. 5 and 6, it is assumed that actual height of the blade edge 8BT of the bucket 8 included in the working implement 2 is Hr, and height of the blade edge 8BT of the bucket 8 recognized by the calibration device 30 illustrated in FIG. 3 is Hb. In a case where the excavator 100 having no attaching error of the IMU 24 is placed on the inclined surface PD, when the swing body 3 illustrated in FIG. 1 swings, the height Hb of the blade edge 8BT recognized by the calibration device 30 is not different from the actual height Hr as illustrated in FIG. 5. The actual height Hr is height from a reference surface PH to the position of the blade edge 8BT. In a case where the excavator 100 having the attachment error of the IMU 24 is placed on the inclined surface PD, when the swing body 3 illustrated in FIG. 1 swings, the height Hb of the blade edge 8BT of the swing body 3 recognized by the calibration device 30 is different from the actual height Hr as illustrated in FIG. 6.

As an example, consider the excavator 100 in which the angel by which the Xi axis of the coordinate system of the IMU 24 is deviated from the Xm axis of the vehicle body coordinate system, that is, the attachment error of the IMU 24 is approximately ±1 degree. When the swing body 3 is rotated in a case where the excavator 100 is placed on the inclined surface PD, the height Hb of the blade edge 8BT recognized by the calibration device 30 has an error. As the inclination of the inclined surface PD becomes larger, in a maximum reaching state of the working implement 2, the height Hb of the blade edge 8BT recognized by the calibration device 30 might include an error such that accuracy for controlling to operate the working implement 2 along a design surface cannot be assured.

Since the pitch angle $\theta p$ affects the position of the blade edge 8BT of the bucket 8 and the roll angle $\theta r$ affects parallelism of the blade edge of the bucket 8, the pitch angle $\theta p$ and the roll angle $\theta r$ of the IMU 24 are subjected to inclination correction at the time of installation. It is found that, as the excavator 1 becomes large in size, the attachment error of the IMU 24 has a larger effect on the error in pitch angle $\theta p$ on the inclined surface, and as a result, the positional accuracy of the blade edge 8BT on the inclined surface is affected. Therefore, in this embodiment, the measurement error of the IMU 24 is corrected.

The error included in the height Hb of the blade edge 8BT recognized by the calibration device 30 is the maximum in a state where a direction from a lower side to an upper side of an inclined surface on which the excavator 100 is placed and the Xm axis of the vehicle body coordinate system are orthogonal to each other. The calibration device 30 and the calibration method according to this embodiment correct the measurement error by correcting the detection value of the IMU 24 in the case where the IMU 24 has the attachment error. A process in which the calibration device 30 executes the calibration method according to this embodiment to correct the measurement error of the IMU 24 is next described.

<Correction of Attachment Error>

Figure 7:
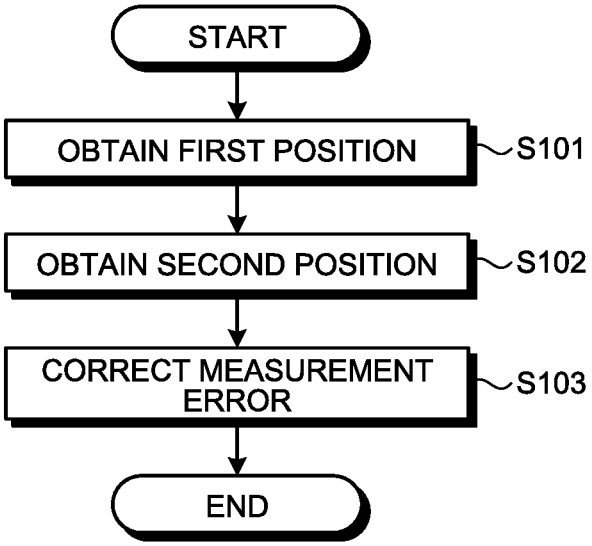
FIG. 7 is a flowchart illustrating a processing example of a calibration method of the work machine according to the first embodiment.
Figure 8:
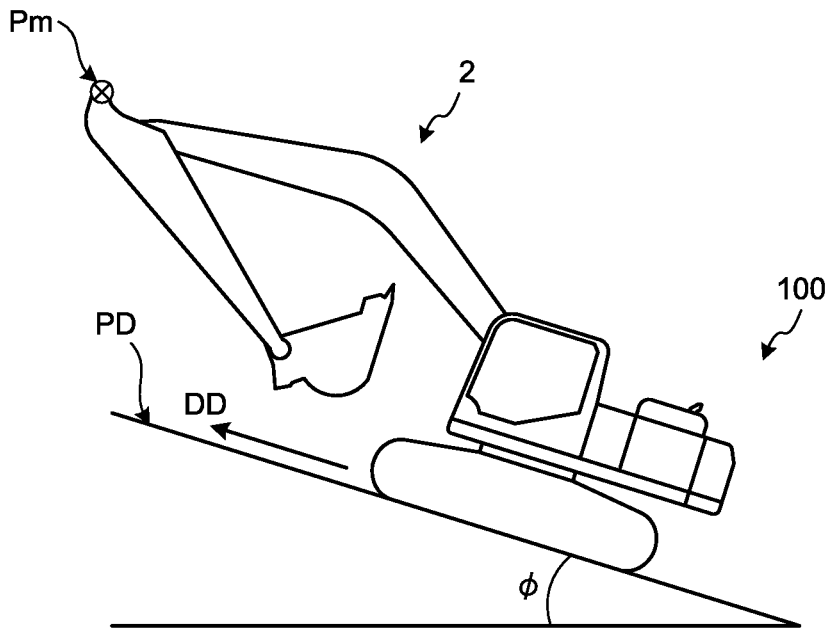
FIG. 8 is a side view illustrating a state in which the excavator is installed on the inclined surface in order to correct a measurement error of the IMU.
Figure 9:
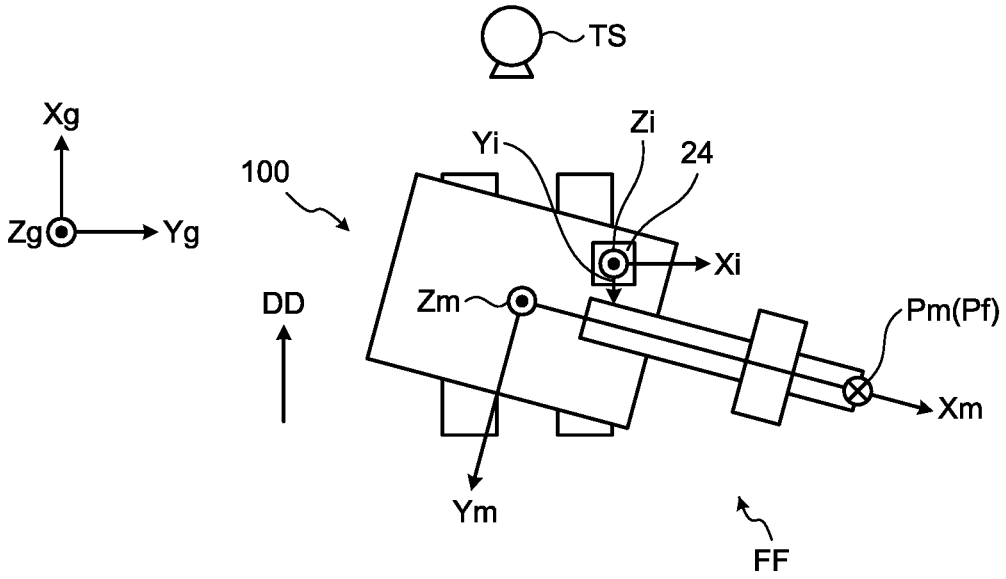
FIG. 9 is a view illustrating a first attitude of the excavator installed on the inclined surface.
Figure 10:
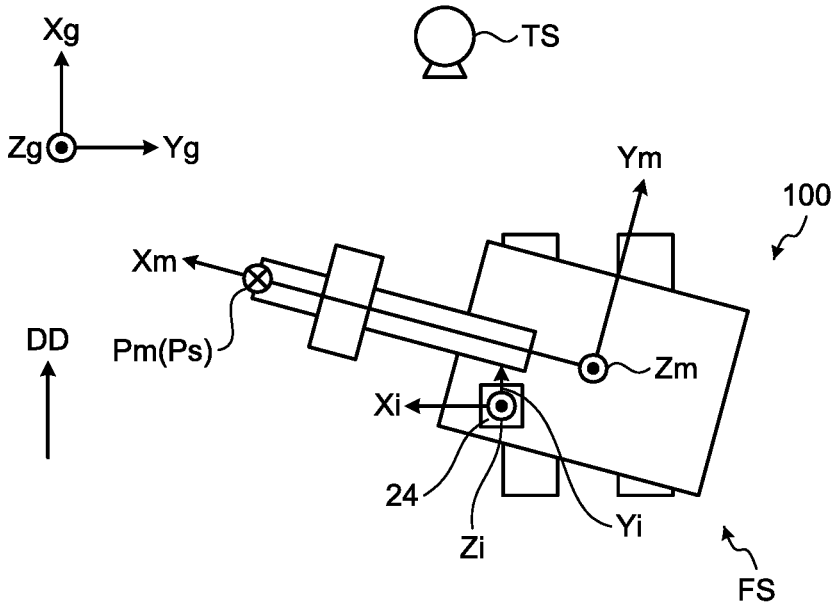
FIG. 10 is a view illustrating a second attitude of the excavator installed on the inclined surface.
Figure 11:
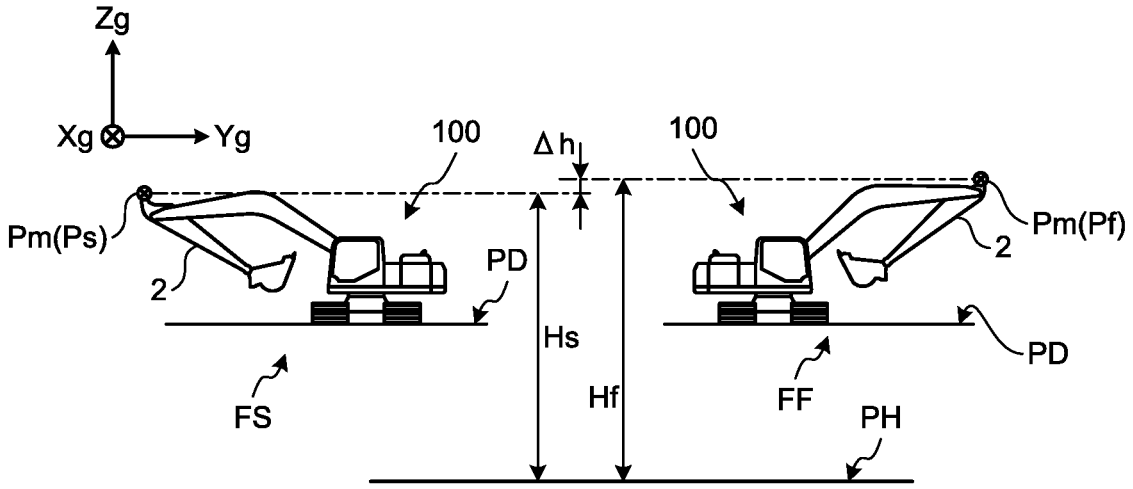
FIG. 11 is a side view illustrating a difference between a position of a working implement in the first attitude and a position of the working implement in the second attitude.
Figure 12:
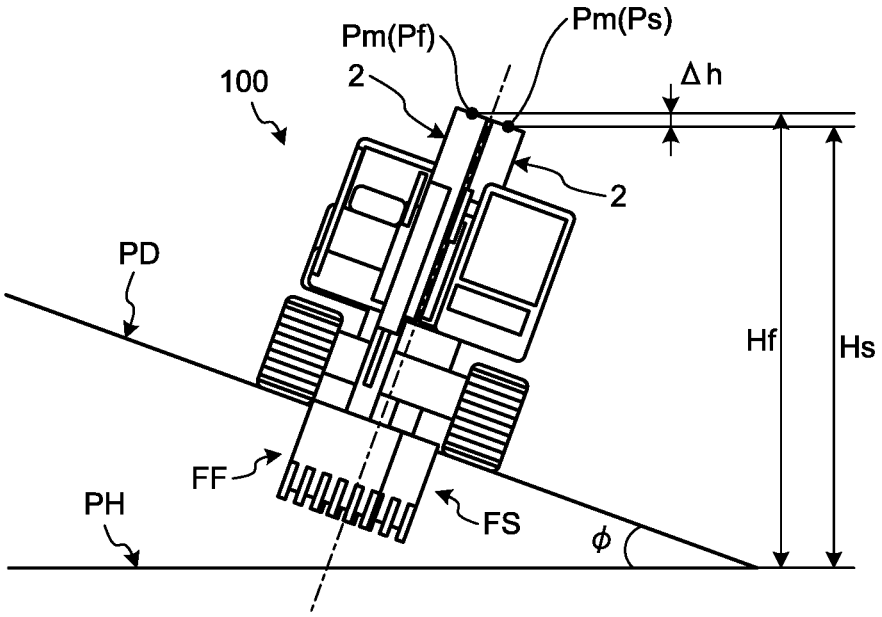
FIG. 12 is a front view illustrating the difference between the position of the working implement in the first attitude and the position of the working implement in the second attitude.

FIG. 7 is a flowchart illustrating a processing example of the calibration method of the work machine according to the first embodiment. FIG. 8 is a side view illustrating a state in which the excavator 100 is installed on the inclined surface PD in order to correct the measurement error of the IMU 24. FIG. 9 is a view illustrating a first attitude FF of the excavator 100 installed on the inclined surface PD. FIG. 10 is a view illustrating a second attitude FS of the excavator 100 installed on the inclined surface PD. FIG. 11 is a side view illustrating a difference between the position of the working implement 2 in the first attitude FF and the position of the working implement 2 in the second attitude FS. FIG. 12 is a front view illustrating the difference between the position of the working implement 2 in the first attitude FF and the position of the working implement 2 in the second attitude FS.

In this embodiment, in a case where the measurement error of the IMU 24 is corrected, as illustrated in FIG. 8, the excavator 100 including the IMU 24 to be corrected is installed on the inclined surface PD with the inclination angle of $\phi$. In this state, the correction unit 31A of the calibration device 30 obtains a first position Pf being a position of a part Pm of the excavator 100 when the excavator 100 is in the first attitude FF illustrated in FIGS. 9 and 11 (step S101). Next, the correction unit 31A of the calibration device 30 obtains a second position Ps being a position of the part Pm of the excavator 100 when the excavator 100 is in the second attitude FS illustrated in FIGS. 10 and 11 (step S102).

The first position Pf is the position when the excavator 100 is installed on the inclined surface PD and the swing body 3 faces in a first direction and the second position Ps is the position when the excavator 100 is installed on the inclined surface PD and the swing body 3 faces in a second direction. That is, the first position Pf and the second position Ps are two different positions when the directions of the swing body 3 are different.

In this embodiment, the part Pm of the excavator 100 may be a part of the swing body 3 and the working implement 2 attached thereto and any position other than a position on the swing center of the swing body 3. In this example, the part Pm is a part of the working implement 2, more specifically, a part of the arm cylinder top pin lib illustrated in FIG. 1, but this is not limited to this part.

The first attitude FF and the second attitude FS are the attitudes when the pitch angle θp output by the IMU 24 is 0 degree. That is, the first position Pf and the second position Ps are the positions where the pitch angle θp output by the IMU 24 is 0 degree. A direction from the lower side to the upper side of the inclined surface PD is an inclination direction DD. An angle between the inclination direction DD and the horizontal surface is the inclination angle ϕ. A direction orthogonal to the inclination direction DD is parallel to the horizontal surface. A case where the pitch angle θp output by the IMU 24 is 0 degree is a case where the Yi axis in the coordinate system of the IMU 24 is parallel to the inclination direction DD.

In the second attitude FS, the attitude of the working implement 2 is different from that in the first attitude FF. In this embodiment, the second attitude FS is the attitude in which the swing body 3 swings from the state in the first attitude FF in which the pitch angle θp output by the IMU 24 is 0 degree and the pitch angle θp output by the IMU 24 is again 0 degree. In this case, the swing body 3 swings by 180 degrees.

In this embodiment, the first position Pf and the second position Ps are the two different positions when the directions of the swing body 3 are different by 180 degrees, but they are not limited to such a positional relationship. For example, the first position Pf and the second position Ps may also be two different positions when the directions of the swing body 3 are different from each other by an angle other than 180 degrees. In this case, it is necessary to correct the first position Pf and the second position Pf according to an angle between the two different directions. It is preferable to set the two different positions when the directions of the swing body 3 are different from each other by 180 degrees to the first position Pf and the second position Ps because it is not necessary to correct the first position Pf and the second position Pf.

The first position Pf and the second position Ps are measured by an external measurement device TS illustrated in FIGS. 9 and 10. In this embodiment, the external measurement device TS is, for example, a measurement device referred to as a total station, but this not limited thereto. In this embodiment, the first position Pf and the second position Ps are positions in the global coordinate system (Xg, Yg, Zg), but they are not limited thereto. The first position Pf and the second position Ps may also be input from the input/output device 26 illustrated in FIG. 3 to the calibration device 30. Also, the calibration device 30 may directly obtain the first position Pf and the second position Ps from the external measurement device TS by connecting the external measurement device TS to the input/output unit 33 of the calibration device 30.

In the case where the IMU 24 has the attachment error, the first position Pf and the second position Ps are different from each other. For example, as illustrated in FIGS. 11 and 12, height Hf of the first position Pf from the reference surface PH is different from height Hs of the second position Ps from the reference surface PH. As a result, a difference Δh between the height Hf and the height Hs is generated. An error D in height of the part Pm caused by the attachment error of the IMU 24 is Δh/2.

In this embodiment, the correction unit 31A of the calibration device 30 corrects the measurement error of the IMU 24 using the first position Pf and the second position Ps (step S103). For example, the calibration device 30 corrects the measurement error of the IMU 24 using the error D obtained from the difference Δh between the first position Pf and the second position Ps. A relationship among a true pitch angle θpt2 in the second attitude FS, the error D, and distance L from the origin of the vehicle body coordinate system to the part Pm of the working implement 2 is obtained by equation (1) by using the inclination angle ϕ and the angle Δθy.

$$\sin \theta pt2 = D/L = \sin \phi \times \sin \Delta\theta y \tag{1}$$

The distance L is the distance from the origin of the vehicle body coordinate system to the part Pm and is the distance in the Xm direction of the vehicle body coordinate system. The distance L is obtained from the attitude and a dimension of the working implement 2. The inclination angle ϕ is the inclination angle of the inclined surface PD on which the excavator 100 is installed at the time of measuring the first position Pf and the second position Ps. The inclination angle ϕ is a peak value of the roll angle θr detected to be output by the IMU 24 when the swing body 3 swings when the excavator 100 moves from the first attitude FF to the second attitude FS. Δθy is a yaw angle error. The yaw angle error Δθy is an angle between the Xi axis and the Xm axis when the Xi axis of the coordinate system of the IMU 24 is deviated from the Xm axis of the vehicle body coordinate system. The yaw angle error Δθy is an error generated when the IMU 24 is rotated around the Zi axis to be attached to the excavator 100, the swing body 3 in this embodiment.

When equation (1) is transformed and solved for the yaw angle error Δθy, equation (2) is obtained.

$$\Delta\theta y = \sin^{-1}\{(D/L)\times(1/\sin \phi)\} \tag{2}$$

The correction unit 31A of the calibration device 30 obtains the yaw angle error Δθy by giving the error D, the distance L, and the inclination angle ϕ obtained from the detection value of the IMU 24 to equation (2). The correction unit 31A of the calibration device 30 stores the obtained yaw angle error Δθy in the storage unit 32 illustrated in FIG. 3. The processing unit 31 of the calibration device 30, more specifically, the position calculation unit 31B illustrated in FIG. 3 reads out the yaw angle error Δθy from the storage unit 32 and corrects the acceleration and angle detected to be output by the IMU 24 using the same.

Equation (3) represents correction values Gxn, Gyn, and Gzn of the acceleration detected to be output by the IMU 24. In a case where the position calculation unit 31B corrects the acceleration obtained from the IMU 24, this corrects equation (3) with the yaw angle error Δθy.

$$\begin{pmatrix} Gxn \\ Gyn \\ Gzn \end{pmatrix} = \begin{pmatrix} \cos\Delta\theta y & -\sin\Delta\theta y & 0 \\ \sin\Delta\theta y & \cos\Delta\theta y & 0 \\ 0 & 0 & 1 \end{pmatrix} \begin{pmatrix} Gx \\ Gy \\ Gz \end{pmatrix} \tag{3}$$

The position calculation unit 31B corrects the angle obtained from the IMU 24, the pitch angle θp and the roll angle θr in this embodiment using the yaw angle error Δθy. Equation (4) represents a corrected roll angle θrn. Equation (5) represents a corrected pitch angle θpn. The position calculation unit 31B gives the yaw angle error Δθy read from the storage unit 32, the roll angle θr and the pitch angle θp output from the IMU 24 to equations (4) and (5), thereby obtaining the corrected roll angle θrn and the corrected pitch angle θpn. The position of the working implement 2 is obtained by using the corrected roll angle θrn, the corrected pitch angle θpn, and the azimuth angle θd.

$$\theta rn = \tan^{-1}\left(\sqrt{1+(\tan\theta r)^2}\,\tan\theta p\cdot\sin\Delta\theta y + \tan\theta r\cdot\cos\Delta\theta y\right) \tag{4}$$

$$\theta pn = \tan^{-1}\left(\frac{\sqrt{1+(\tan\theta r)^2}\,\tan\theta p\cdot\cos\Delta\theta y - \tan\theta r\cdot\sin\Delta\theta y}{\sqrt{\left(\sqrt{1+(\tan\theta r)^2}\,\tan\theta p\cdot\sin\Delta\theta y + \tan\theta r\cdot\cos\Delta\theta y\right)^2+1}}\right) \tag{5}$$

An example of obtaining the position of the blade edge 8BT of the bucket 8 (hereinafter referred to as blade edge position) as the position of the working implement 2 is described. Assuming that the blade edge position is PB, the blade edge position PB in the vehicle body coordinate system (Xm, Ym, Zm) is obtained from the dimension and attitude of the working implement 2. The obtained blade edge position PB is converted from the vehicle body coordinate system (Xm, Ym, Zm) to the value of the global coordinate system (Xg, Yg, Zg) by, for example, equation (1).

$$PBg = R\cdot PBm + T \tag{6}$$

PBg in equation (6) represents the blade edge position PB in the global coordinate system (Xg, Yg, Zg), PBm represents the blade edge position PB in the vehicle body coordinate system, R represents a rotation matrix represented by equation (7), and T represents a translation vector represented by equation (8).

$$R = \begin{pmatrix} \cos\theta d & -\sin\theta d & 0 \\ \sin\theta d & \cos\theta d & 0 \\ 0 & 0 & 1 \end{pmatrix}\begin{pmatrix} \cos\theta p & 0 & \sin\theta p \\ 0 & 1 & 0 \\ -\sin\theta p & 0 & \cos\theta p \end{pmatrix}\begin{pmatrix} 1 & 0 & 0 \\ 0 & \cos\theta r & -\sin\theta r \\ 0 & \sin\theta r & \cos\theta r \end{pmatrix} \tag{7}$$

$$T = \begin{pmatrix} x_0 \\ y_0 \\ z_0 \end{pmatrix} \tag{8}$$

As is understood from equation (7), the rotation matrix R includes the roll angle θr, the pitch angle θp, and the azimuth angle θd. The roll angle θr and the pitch angle θp are values detected to be output by the IMU 24. The azimuth angle θd is a value calculated to be output by the position detection device 23 from the relative positions of the antennas 21 and 22. The translation vector T is obtained from the positional relationship between the positions of the antennas 21 and 22 in the global coordinate system (Xg, Yg, Zg) detected by the position detection device 23 and the vehicle body coordinate system (Xm, Ym, Zm).

<Variation 1>

A true pitch angle θpt2 in a second attitude FS is obtained by equation (9) using an error D and a distance L from an origin of a vehicle body coordinate system to a part Pm of a working implement 2.

$$\theta pt2 = \sin^{-1}(D/L) \tag{9}$$

A correction unit 31A of a calibration device 30 obtains the true pitch angle θpt2 using equation (9). A relationship among the true pitch angle θpt2, a yaw angle error Δθy, and a roll angle θr and a pitch angle θp detected to be output by an IMU 24 may be obtained from equations (4) and (5).

<Variation 2>

Figure 13:
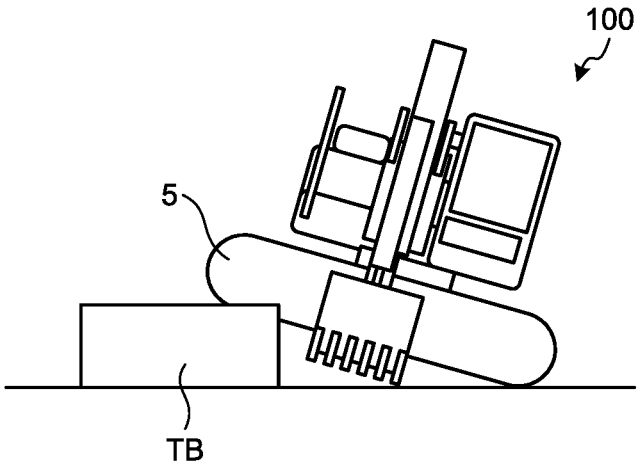
FIG. 13 is a view illustrating a variation for obtaining the first attitude and the second attitude.

FIG. 13 is a view illustrating a variation for obtaining a first attitude FF and a second attitude FS. In the example described above, as illustrated in FIG. 8, an excavator 100 is installed on an inclined surface PD. In the variation, as illustrated in FIG. 13, it is possible to realize an attitude similar to that in a case where the excavator 100 is installed on the inclined surface PD by allowing a part of a travel body 5 of the excavator 100 to run on a platform TB. By using the platform TB, even in a place where the inclined surface PD is not present, a calibration device 30 may correct a measurement error caused by an attachment error of an IMU 24 by preparing the platform TB.

In this embodiment and its variation, the IMU 24 is installed with a yaw angle deviated with respect to a longitudinal direction of the excavator 100, so that an error included in a detection value of the IMU 24 caused by generation of inclination may be corrected. The attachment error of the IMU 24 in a yaw direction hardly affects accuracy when a position of a working implement 2 is obtained in a state in which a vehicle body 1 of the excavator 100 to which the IMU 24 is attached is horizontal, but when the excavator 100 is placed on an inclined land, the accuracy when the position of the working implement 2 is obtained decreases. Especially, the accuracy when the position of the working implement 2 is obtained in an attitude in which the vehicle body 1 of the excavator 100 rolls decreases.

In this embodiment and its variation, two positions of a part of the excavator 100 measured in two attitudes including at least one attitude in which the vehicle body 1 of the excavator 100 is inclined are used to correct the measurement error caused by the attachment error of the IMU 24. In this manner, since at least one attitude, two attitudes in this embodiment in which the excavator 100 is inclined in which the effect of the attachment error of the IMU 24 in the yaw direction easily occurs are used, a correction amount for correcting the measurement error due to the attachment error in the yaw direction of the IMU 24 may be easily obtained.

In this embodiment and its variation, in an attitude in which the vehicle body 1 of the excavator 100 rolls, that is, in a first attitude FF and a second attitude FS in which a pitch angle θp output by the IMU 24 is 0 degree, a first position Pf and a second position Ps are measured. From the first position Pf and the second position Ps measured in this manner, the correction amount for correcting the attachment error of the IMU 24 in the yaw direction, that is, a yaw angle error Δθy is obtained. In this manner, since the first position Pf and the second position Ps are obtained in an attitude in which the accuracy of the position of the working implement 2 is greatly reduced, a difference between them is large. As a result, it is possible to reduce the effect of the measurement error of the first position Pf and the second position Ps, so that the deterioration in accuracy of the correction amount described above is inhibited.

In this embodiment and its variation, since a part Pm of the excavator 100 is measured using an external measurement device TS, it is possible to correct the pitch angle θp and a roll angle θr detected to be output by the IMU 24 with a high degree of accuracy. Also, in this embodiment and its variation, the external measurement device TS eliminates the need for measurement using positioning satellites such as GPS, so that they are not affected by a positioning error in the measurement using the positioning satellites. As a result, in this embodiment and its variation, the pitch angle θp and the roll angle θr detected to be output by the IMU 24 may be corrected with a high degree of accuracy.

Configurations of this embodiment and its variation may also be appropriately applied in the following.

Second Embodiment

Figure 14:
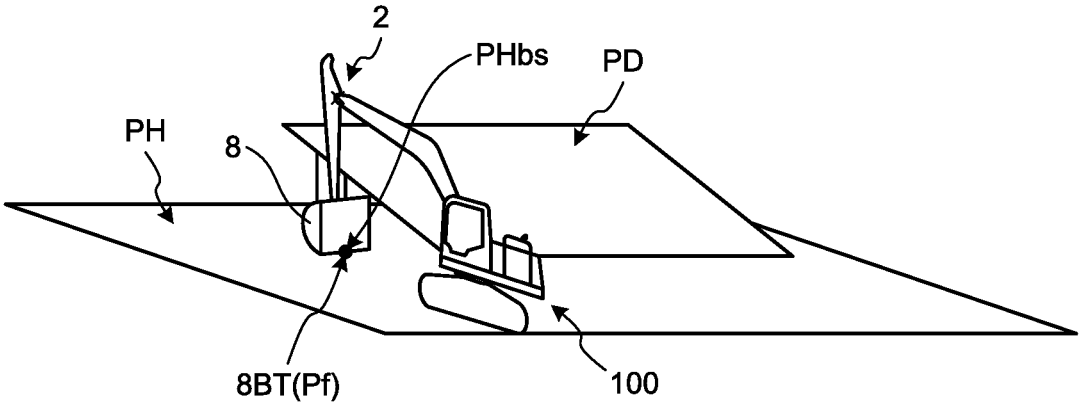
FIG. 14 is a view illustrating an example of measuring a first position in a first attitude in a second embodiment.

FIG. 14 is a view illustrating an example of measuring a first position Pf in a first attitude FF in a second embodiment.

Figure 15:
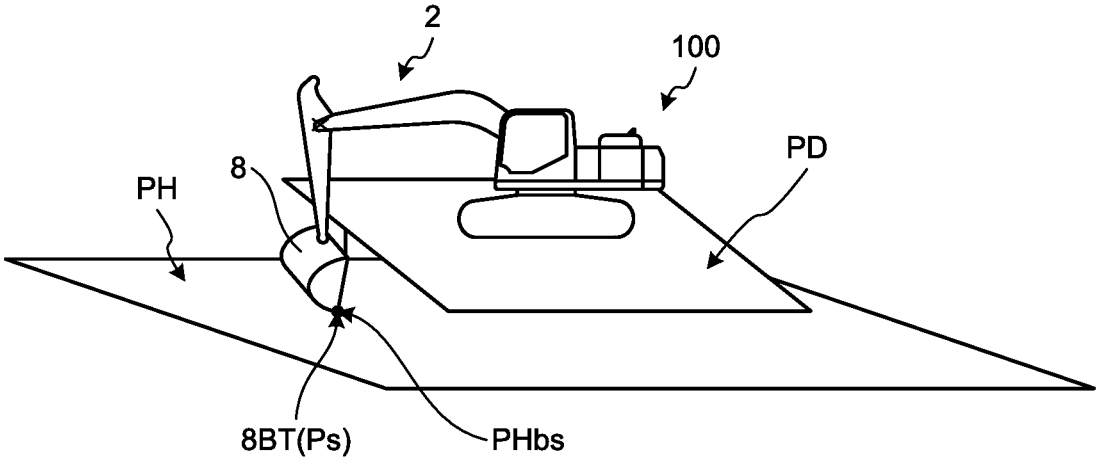
FIG. 15 is a view illustrating an example of measuring a second position in a second attitude in the second embodiment.

FIG. 15 is a view illustrating an example of measuring a second position Ps in a second attitude FS in the second embodiment. In this embodiment, an excavator 100, a position detection device 23, an IMU 24, a control device 25, a calibration device 30, and a calibration system 40 are similar to those in the first embodiment, so that the description thereof is omitted. Next, a processing example of a calibration method of a work machine according to the second embodiment is described with reference to a flowchart illustrated in FIG. 7.

In this embodiment, the first position Pf and the second position Ps illustrated in FIG. 14 are positions of a part of the excavator 100, a part Pm of a working implement 2 obtained on the basis of a position of other than the excavator 100 (hereinafter appropriately referred to as a measurement position) in this example. In this embodiment, the measurement position is a part PHbs of a reference surface PH. It is sufficient that the measurement position is immovable or the same when the first position Pf is measured and when the second position Ps is measured, and is not limited to the part PHbs of the reference surface PH. Hereinafter, the part PHbs of the reference surface PH is appropriately referred to as a measurement position PHbs.

The first position Pf and the second position Ps are obtained using information regarding an attitude of the excavator 100 output from the IMU 24. In the information regarding the attitude of the excavator 100, a roll angle θr, a pitch angle θp, and an azimuth angle θd are exemplified.

In this embodiment, the part Pm of the working implement 2 is a blade edge 8BT of a bucket 8. The first position Pf is a position of the blade edge 8BT when the blade edge 8BT comes into contact with the measurement position PHbs when the excavator 100 is in the first attitude FF. The second position Ps is a position of the blade edge 8BT when the blade edge 8BT comes into contact with the measurement position PHbs when the excavator 100 is in the second attitude FS. In this manner, the first position Pf and the second position Ps are obtained in a state in which the same blade edge 8BT of the bucket 8 comes into contact with the same portion of a reference point. The position of the blade edge 8BT is obtained by a position calculation unit 31B of the calibration device 30 illustrated in FIG. 3 using the roll angle θr and the pitch angle θp which are the information regarding the attitude of the excavator 100 output from the IMU 24. In this embodiment, when obtaining the position of the blade edge 8BT, in addition to the roll angle θr and the pitch angle θp output from the IMU 24, a position azimuth angle θd of the working implement 2, and the attitude and dimension of the working implement 2 are used.

The first attitude FF is the attitude of the excavator 100 in a state in which the excavator 100 is installed on the reference surface PH. The second attitude FS is the attitude of the excavator 100 in a state in which the excavator 100 is installed on an inclined surface PD inclined with respect to the reference surface PH. A correction unit 31A of the calibration device 30 obtains the first position Pf when the excavator 100 is in the first attitude FF (step S101 in FIG. 7). Next, the correction unit 31A of the calibration device 30 obtains the second position Ps when the excavator 100 is in the second attitude FS (step S102 in FIG. 7).

In a case where a yaw angle θy output from the IMU 24 includes a yaw angle error Δθy, the first position Pf and the second position Ps do not coincide with each other. This is because, if there is the yaw angle error Δθy, the pitch angle θp and the roll angle θr output by the IMU 24 also include errors. In order to correct the pitch angle θp and the roll angle θr, the correction unit 31A of the calibration device 30 illustrated in FIG. 3 corrects the yaw angle error Δθy and obtains a corrected pitch angle θpn and a corrected roll angle θrn using equations (4) and (5) described above. The position calculation unit 31B recalculates the first position Pf and the second position Ps using the corrected pitch angle θpn and the corrected roll angle θrn.

The correction unit 31A obtains a difference (hereinafter appropriately referred to as a position difference) between the first position Pf and the second position Ps obtained by the position calculation unit 31B and compares the same with a threshold. The correction unit 31A determines whether the position difference is equal to or smaller than the threshold. In a case where the position difference is larger than the threshold, the correction unit 31A and the position calculation unit 31B repeat the correction of the yaw angle error Δθy and the recalculation of the first position Pf and the second position Ps until the position difference becomes equal to or smaller than the threshold. The correction unit 31A stores the yaw angle error Δθy when the difference between the first position Pf and the second position Ps is equal to or smaller than the threshold in a storage unit 32 illustrated in FIG. 3 as an attachment error in a yaw direction of the IMU 24. The position calculation unit 31B reads out the yaw angle error Δθy from the storage unit 32 and corrects acceleration, the pitch angle θp, and the roll angle θr detected to be output by the IMU 24 using equations (4) and (5). In this manner, the calibration device 30 corrects a measurement error of the IMU 24 using the yaw angle error θy obtained using the first position Pf and the second position Ps (step S103 in FIG. 7).

The correction unit 31A repeats the recalculation of the first position Pf and the second position Ps while correcting using a parameter for correcting the information regarding the attitude of the excavator 100, the yaw angle error Δθy, in this embodiment. Then, the correction unit 31A of the calibration device 30 uses the yaw angle error Δθy when the difference between the first position Pf and the second position Ps (hereinafter appropriately referred to as position difference) becomes equal to or smaller than the threshold to correct the measurement error caused by the attachment error of the IMU 24.

In this manner, the calibration device 30 may correct an error included in a detection value of the IMU 24 caused by the fact that the IMU 24 is inclined with respect to a longitudinal direction of the excavator 100 and deviation in the yaw direction is generated. In this embodiment, in a case where the correction unit 31A corrects the yaw angle error Δθy, the correction unit 31A determines, for example, an initial value of the yaw angle error Δθy, and changes the yaw angle error Δθy by a predetermined magnitude from the initial value in both directions in which the yaw angle error Δθy increases/decreases from the initial value. For example, the initial value of the yaw angle error Δθy may be 0 degree and a predetermined magnitude may be 0.01 degree, but they are not limited to these values.

The threshold compared with the position difference is not limited, but an absolute value of a distance is used, for example. In this case, the threshold may be, for example, approximately a measurement error of GNSS. The yaw angle θy when the difference between the first position Pf and the second position Ps obtained by the recalculation becomes equal to or smaller than a predetermined ratio of the difference between the first position Pf and the second position Ps before correction may be used to correct the measurement error. In this case, the threshold is a predetermined ratio of the difference between the first position Pf and the second position Ps before the correction. A predetermined ratio may be set to, for example, 1% or 5%, but is not limited to these values.

In a case where the acceleration obtained from the IMU 24 is corrected, the position calculation unit 31B corrects the same with the yaw angle error Δθy. The position calculation unit 31B corrects the roll angle θr and the pitch angle θp detected to be output by the IMU 24 by using the yaw angle error Δθy when the position difference is equal to or smaller than the threshold as a correction value.

This embodiment corrects the measurement error caused by the attachment error of the IMU 24 using the position of a part of the excavator 100 measured in the two attitudes including at least one attitude in which the vehicle body 1 of the excavator 100 is inclined. At that time, the position of a part of the excavator 100 is measured with reference to the measurement position PHbs other than the excavator 100. In this manner, in this embodiment, since at least one attitude in which the excavator 100 is inclined which is likely to be affected by the attachment error of the IMU 24 in the yaw direction is used, a correction amount for correcting the attachment error of the IMU 24 in the yaw direction may be easily obtained. In this embodiment, since an external measurement device TS is unnecessary, the measurement error caused by the attachment error of the IMU 24 may be corrected even in a place where there is no external measurement device TS, for example, in a work site of the excavator 100.

Although the blade edge 8BT of the bucket 8 is brought into contact with the measurement position PHbs of the reference surface PH in this embodiment, if the positional relationship between the blade edge 8BT and the measurement position PHbs is known, the measurement position PHbs and the blade edge 8BT are not necessarily brought into contact with each other. For example, the calibration device 30 may obtain the first position Pf and the second position Ps by using the output of the IMU 24 when the blade edge 8BT is stopped at a predetermined upper position in a vertical direction of the measurement position PHbs. In this manner, the first position Pf and the second position Ps may be a position of a part of the excavator 100 obtained with reference to the position other than the excavator 100. Also, the position of a part of the excavator 100 is not limited to the blade edge 8BT of the bucket 8, and may be, for example, a butt portion of the bucket 8 or a part of a second link member 48 illustrated in FIG. 1.

Although the first embodiment, the variation thereof, and the second embodiment are described above, they are not limited by the contents described above. The above-described components include a component easily conceived of by one skilled in the art, the substantially same component, and a so-called equivalent component. Furthermore, the above-described components may be appropriately combined. Furthermore, it is also possible to variously omit, replace, and change the components without departing from the gist of the first embodiment, the variation thereof, and the second embodiment.

REFERENCE SIGNS LIST

1 VEHICLE BODY
2 WORKING IMPLEMENT
3 SWING BODY
4 DRIVING ROOM
5 TRAVEL BODY
6 BOOM
7 ARM
8 BUCKET
8B BLADE
8BT BLADE EDGE
10 BOOM CYLINDER
11 ARM CYLINDER
12 BUCKET CYLINDER
13 BOOM PIN
14 ARM PIN
15 BUCKET PIN
23 POSITION DETECTION DEVICE
25 CONTROL DEVICE
26 INPUT/OUTPUT DEVICE
30 CALIBRATION DEVICE
31 PROCESSING UNIT
31A CORRECTION UNIT
31B POSITION CALCULATION UNIT
32 STORAGE UNIT
33 INPUT/OUTPUT UNIT
40 CALIBRATION SYSTEM
100 EXCAVATOR
D ERROR
FF FIRST ATTITUDE
FS SECOND ATTITUDE
L DISTANCE
PD INCLINED SURFACE
Pf FIRST POSITION
PH REFERENCE SURFACE
PHbs MEASUREMENT POSITION
Pm PART
Ps SECOND POSITION
TB PLATFORM
TS EXTERNAL MEASUREMENT DEVICE
θr ROLL ANGLE
θp PITCH ANGLE
θy YAW ANGLE
ϕ INCLINATION ANGLE
Δθy YAW ANGLE ERROR

The invention claimed is:

1. A calibration device of a work machine that includes a swing body which swings and a working implement being attached to the swing body, the calibration device comprising:

a processing unit configured to obtain an attitude measurement of an attitude of the work machine which is detected by an attitude detection device and configured to correct a measurement error in the attitude measurement of the attitude detection device to obtain a corrected attitude measurement, the error being caused by deviation of the attitude detection device with respect to the work machine and corrected by using a first position and a second position, wherein the first position is a position of a part of the work machine when the work machine is in a first attitude that the work machine is in a predetermined inclined state and the second position is a position of the part when the work machine is in a second attitude that the work machine is in an inclined state, the second attitude being different from the first attitude.

2. The calibration device of the work machine according to claim 1, wherein the position of the part includes a position of a part of the working implement, the first position includes a position when the work machine is installed on an inclined surface and the swing body faces in a first direction, and the second position includes a position when the work machine is installed on the inclined surface and the swing body faces in a second direction.

3. The calibration device of the work machine according to claim 2, wherein the first position and the second position include positions when a pitch angle output by the attitude detection device is 0 degree.

4. The calibration device of the work machine according to claim 1, wherein the position of the part includes a position of a part of the working implement included in the work machine.

5. A calibration device of a work machine that includes a swing body which swings and a working implement being attached to the swing body, the calibration device comprising:

a processing unit configured to obtain an attitude measurement of an attitude of the work machine which is detected by an attitude detection device and configured to correct a measurement error in the attitude measurement of the attitude detection device to obtain a corrected attitude measurement, the error being caused by deviation of the attitude detection device with respect to the work machine and corrected by using a first position and a second position, wherein the first position is a position of a part of the work machine when the work machine is in a first attitude and the second position is a position of the part when the work machine is in a second attitude, wherein the first position and the second position include positions of the part obtained by using a position other than the work machine as a standard, the positions being obtained by using information regarding the attitude of the work machine output from the attitude detection device.

6. The calibration device of the work machine according to claim 5, wherein the calibration device is configured to repeat recalculation of the first position and the second position while correcting a parameter for correcting the information regarding the attitude of the work machine to correct the error by using the parameter when the difference between the first position and the second position becomes equal to or smaller than a threshold.

7. The calibration device of the work machine according to claim 6, wherein the information regarding the attitude of the work machine includes a pitch angle and a roll angle output by the attitude detection device.

8. A work machine including the calibration device of the work machine according to claim 1.

9. A calibration method of a work machine comprising:

obtaining an attitude measurement of an attitude of the work machine which is detected by an attitude detection device;

obtaining a first position which is a position of a part of a work machine when the work machine is in a first attitude that the work machine is in a predetermined inclined state, the work machine including a swing body which swings, a working implement being attached to the swing body;

obtaining a second position which is a position of the part when the work machine is in a second attitude that the work machine is in an inclined state, the second attitude being different from the first attitude; and correcting a measurement error in the attitude measurement of the attitude detection device to obtain a corrected attitude measurement, the error being caused by deviation of the attitude detection device with respect to the work machine and corrected by using the first position and the second position.

10. The calibration device of the work machine according to claim 1, wherein the deviation comprises a deviation of the attitude detection device, as installed on the work machine, in yaw angle with respect to a longitudinal direction of the work machine.

11. The calibration device of the work machine according to claim 1, wherein the attitude measurement, which is detected by the attitude detection device, comprises a roll angle, pitch angle or yaw angle.

* * * * *